United States Patent [19]

Fricker

[11] Patent Number: 4,687,052

[45] Date of Patent: Aug. 18, 1987

[54] SUPPORT SYSTEM FOR COILED TUBE BUNCH OF A HEAT EXCHANGER

[75] Inventor: Hans Fricker, Rickenbach-Attikon, Switzerland

[73] Assignee: Sulzer-Ruti Machinery Work Ltd., Ruti, Switzerland

[21] Appl. No.: 766,929

[22] Filed: Aug. 19, 1985

[30] Foreign Application Priority Data

Aug. 21, 1984 [CH] Switzerland ..... 3999/84

[51] Int. Cl.[4] ..... F28D 7/02

[52] U.S. Cl. ..... 165/82; 165/162; 165/163

[58] Field of Search ..... 165/162, 163, 82

[56] References Cited

U.S. PATENT DOCUMENTS 3,228,463 1/1966 Kagi ..... 165/162

4,190,104 2/1980 Frei ..... 165/162

4,284,134 8/1981 Harris ..... 165/163

*Primary Examiner*—William R. Cline

*Assistant Examiner*—Richard R. Cole

*Attorney, Agent, or Firm*—Kenyon & Kenyon

[57] ABSTRACT

The heat exchanger is constructed with an expansion zone between the two groups of support plates for the helical tubes. In addition, the upper group of support plates is connected at the upper ends to a cross. A lower group of support plates is connected to a lower part of a displacement member which slides in an upper part of the displacement member. Links are also provided to secure the lower support plates to the bottom of the pressure vessel. The inlet and outlet connections for the secondary medium are provided at opposite ends of the coiled tubes.

12 Claims, 1 Drawing Figure

SUPPORT SYSTEM FOR COILED TUBE BUNCH OF A HEAT EXCHANGER

Figure 1:
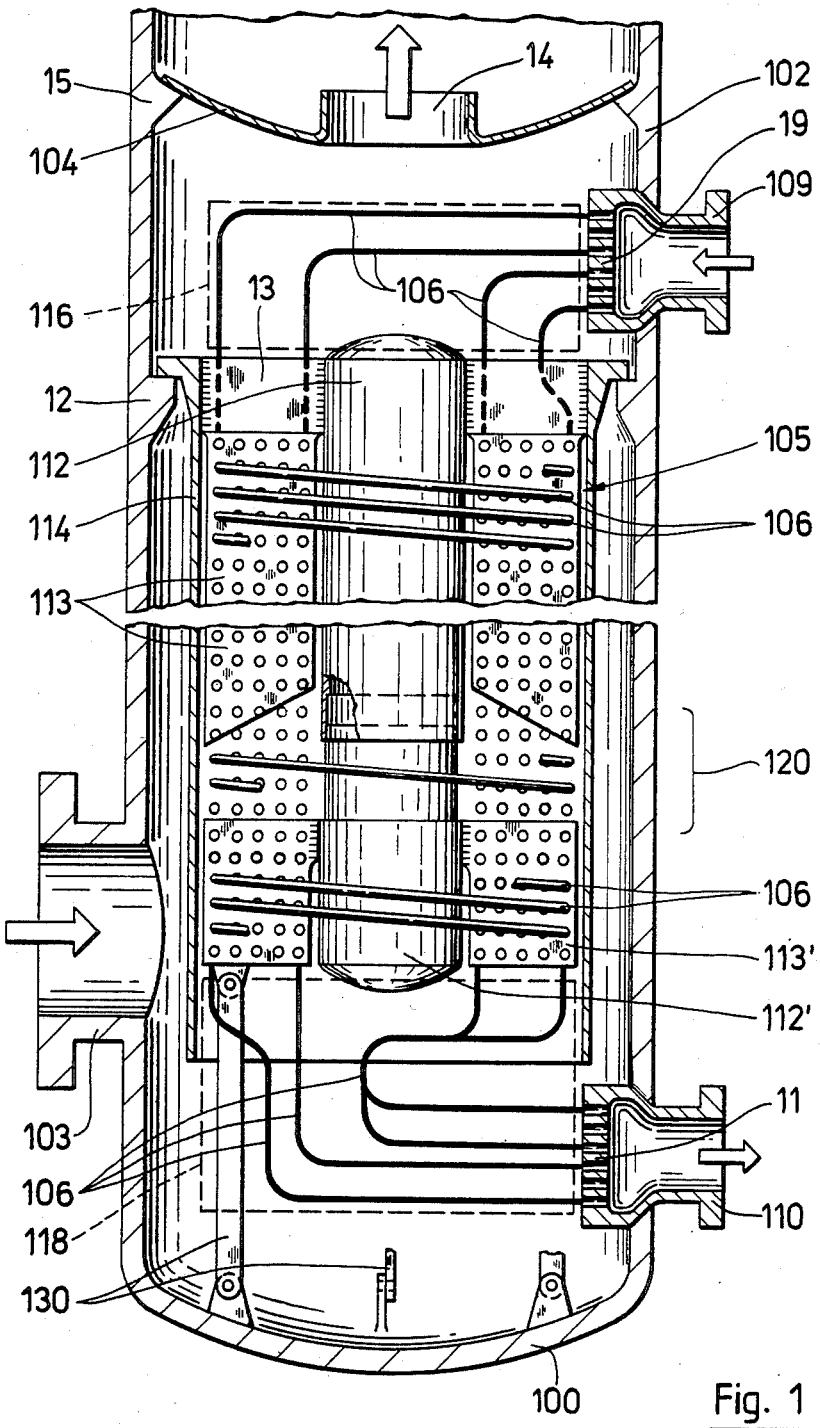

This invention relates to a heat exchanger. More particularly, this invention relates to a heat exchanger for cooling gas from a high temperature reactor.

Heretofore, various types of heat exchanges have been known, for example, for the cooling of gas from a high temperature reactor. As described in German PS 3,037,386, one known heat exchanger has been constructed of a pressure vessel in which a plurality of tubes are helically disposed along coaxial cylindrical surfaces with the tubes being retained in a support system embodied by two axially consecutive groups of support plates. Each group of support plates is comprised of at least three plates which are distributed over the circumference of a tube bunch formed by the plurality of tubes and through which the convolutions of the tubes pass. Such a heat exchanger has been used for cooling gas at a very high temperature of, for example, 800° C. During operation, the hot gas to be cooled is passed over the tube bunch while a secondary medium which acts as a coolant is passed through the tubes of the tube bunch for extracting heat from the hot gas. To this end, the outlet ends of the tubes have been connected to a pipe disposed at the center of the tube bunch, that is, the central tube serves to remove the coolant after the coolant has flowed through the tubes of the bunch in taking up heat from the hot gas.

In addition, it has been known to have each group of support plates secured to the central tube by way of relatively thin-walled sleeves for the purpose of making the support system radially resilient. The plates of a top group can bear on the registering plates of the group below in order to keep away from the sleeves most of the torques acting on the plates.

However, this type of heat exchanger has a disadvantage which resides in the need for the central tube for securing the plates. Also, the heat exchanger is suitable mainly for a tube bunch of an axial extent such that axial heat expansion is not a serious problem.

Accordingly, it is an object of the invention to provide an improved heat exchanger which does not require a central tube for supporting support plates for a tube bunch.

It is another object of the invention to provide a heat exchanger with a support system that is able to support a tube bunch of substantial axial length.

It is another object of the invention to provide for axial heat expansion within a heat exchanger employing coiled tubes.

Briefly, the invention provides a heat exchanger which is comprised of a pressure vessel which defines a flow path for a flowable medium, a tube bunch which is disposed within the flow path in the pressure vessel with each tube of said bunch extending helically and a support system for supporting the tube bunch within the pressure vessel. In accordance with the invention, the support system includes two groups of support plates which are disposed in axially spaced relation to define a plate-free expansion zone therebetween and which are secured to the pressure vessel at ends remote from each other.

The provision of the expansion zone between the groups of support plates aids in solving the heat expansion problems associated with a tube bunch of very considerable axial extent.

The heat exchanger also includes an inlet connection laterally on the pressure vessel for supplying a secondary medium to the tube bunch and an outlet connection laterally on the pressure vessel for receiving the secondary medium from the tube bunch. Thus, there is no need to have a line at the center of the tube bunch for removing the secondary medium nor for the outlet ends of the tubes of the tube bunch to be returned individually to the inlet side by means of a tube through a central space of the tube bunch. By leading the outlet ends of the tube bunch out of the pressure vessel directly at the outlet end of the bunch results in a less elaborate construction than in previous known heat exchangers.

These and other objects and advantages of the invention will become more apparent from the following detailed description taken in conjunction with the accompanying drawing wherein:

FIG. 1 illustrates a cross sectional view of a heat exchanger constructed in accordance with the invention.

Referring to the drawing, the heat exchanger includes a cylindrical pressure vessel 102 which is disposed on a vertical central axis with a bottom outwardly convex base 100. As indicated, a gas inlet connection 103 is provided near the bottom end of the vessel 102 and is connected to a line (not shown) for the supplying of hot gas such as helium to the vessel 102, for example from a high temperature reactor. The top end of the vessel 102 has a downwardly convex cover 104 which is formed with a central gas outlet aperture 14 for exhausting the cooled helium gas. As indicated, the cover 104 is carried on a peripherally inwardly projecting flange 15 of the vessel 102 and is secured thereto by screws or bolts (not shown). The pressure vessel 102 thus defines a flow path for the hot gas between the inlet connection 103 and the outlet aperture 14.

The heat exchanger also has a tube bunch 105 disposed within the flow path. The tube bunch 105 comprises of tubes 106 which are disposed helically about the central axis of the pressure vessel. The tubes 106 extends sinously in helices over most of their length and form a number of coaxial cylindrical surfaces.

An inlet connection 109 is disposed laterally on the pressure vessel 102 below the cover 104 for supplying a secondary medium, such as water, to the tube bunch 105 while an outlet connection 110 is disposed laterally near the bottom end of the pressure 102 for exhausting the heated secondary medium, for example in the form of steam, from the tube bunch 105. As indicated, the inlet connection 109 widens inside the pressure vessel 102 and terminates in a vertical tube plate 19 formed with horizontal bores. In like manner, the outlet connection 110 which is disposed between the bottom end of the tube bunch 105 and the base 100 terminates in a vertical tube plate 11 formed with horizontal bores.

A cylindrical jacket 114 is disposed coaxially within the vessel 102 and extends around the tube bunch 105. The jacket 114 extends downwardly to a level between the gas inlet connection 103 and the outlet connection 110 while being secured on an inner horizontal flange 12 of the pressure vessel 102. As indicated, the flange 12 is disposed below the water inlet connection 109.

A support system is also provided for the tube bunch 105. To this end, the support system includes a multi-armed spider, such as a four-armed cross 13 which is secured to and within the upper end of the jacket 114. In addition, the support system includes a tubular displacement member, for example a cylindrical member having two parts 112, 112' which are slidably mounted in telescopic relation to each other and mounted on the central axis of the pressure vessel 102. The top part 112 of the displacement member is closed at the top end and is secured to the cross 13 while extending downwardly to a level about the gas inlet connection 103. The bottom part 112' is closed at the bottom end and is reduced in diameter at the top end so as to extend into the bottom end of the top member 112 to permit the two parts to slide one within the other.

The support system also includes a first group of four support plates 113 which extend downwardly from the cross 13. Each support plate 113 extends vertically downwards and is secured at the lower end of a respective arm of the cross 13. The bottom edge of each plate 113 extends angularly with a downward inclination from the inside to the outside so that the plate 113 are longer externally than internally.

A second group of support plates 113', for example four, extend radially at the level of the part 112' and are aligned with the plate 113 of the upper group of plates. As indicated, each plate 113' is secured to the lower part 112' of the displacement member on the radial inside surface while the top edge of each plate 113' extends horizontally.

As shown, the two groups of plates 113, 113' are consecutively spaced in axially spaced apart relations so as to define a plate-free expansion zone 120.

The tubes 106 are connected to the tube plate 19 of the water inlet connection 109 and are initially distributed in a top reversal zone 116 uniformly about the top part 112 of the displacement member. The tubes 106 then extend downwardly in the form of helically extending tubes as far as the bottom end of the lower part 112' of the displacement member. Thereafter, the tubes 106 extend through a bottom reversal or deflection zone 118 and terminate at the tube plate 11 of the steam outlet connection 110. The shape of the tubes in the reversal zone 118, which is the hottest zone of the heat exchanger, is such that the tube parts in the zone can deform readily as a result of heat expansion.

In their helical parts, the tubes 106 extend through apertures in the plates 113, 113' so that the tubes are guided and retained in a secured manner. Within the expansion zone 120, the turns of the tubes 106 extend like helical springs and with substantially the same pitch as in the parts where the tubes extend through the support plates 113, 113'.

Due to the downwardly inclined bottom edges of the plates 113, the tubes 106 near the parts 112, 112' of the displacement member are of greater axial length in the expansion zone 120 than the outwardly disposed tubes. This serves to improve the expansion correlation between the inner tubes which have a small turn radius and the outer tubes which have a larger turn radius.

As illustrated, the support system has a plurality of links 130 between the lower group of support plates 113' and the bottom 100 of the pressure vessel 102. As indicated, each link 130 is pivotally secured to a respective plate 113' and pivotally secured to the bottom 100 of the pressure vessel 102. The plates 113' are not connected to the jacket 114 and so, the lower group of plates 113' can expand axially independently of the jacket 114.

When the heat exchanger is in operation, hot helium at a temperature of approximately 700° C. and a pressure of approximately 65 bar flows through the gas inlet connection 103 into the vessel 102 and is distributed in the annular chamber between the pressure vessel wall and the jacket 114. The hot gas also flows into the bottom reversal zone 118 below the jacket 114, then flows through the space between the jacket 114 and the displacement members 112, 112', the gas being cooled by the tubes 106 during flow. By way of the central opening 14, the gas departs—still at a pressure of approximately 65 bar but at a temperature of only 280° C.—to a blower (not shown).

The helium gas is cooled by a heat exchange with water supplied to the tubes 106 through the water inlet connection 109 at a temperature of approximately 200° C. The water evaporates in the helical parts of the tubes 106 and issues from the heat exchanger at a temperature of approximately 530° C. and at a pressure of approximately 185 bar by way of the steam outlet connection 110, the steam then being used for electricity generation and/or heating.

Although the steam outlet connection 110 is disposed in the hottest part of the heat exchanger, the shape which the tubes 106 need to have in the bottom reversal zone 118 is relatively simple to determine since they have to compensate for only minor radial expansions. It is an even simpler matter to design the tubes 106 in the top reversal zone 116. Since the first plate group is secured at its top end and the second plate group is secured by the links 130 to the vessel base 100, both groups can, because of the expansion zone 120, move relatively to one another axially, within the limits of design heat expansions, without substantial stressing occurring. Radial heat expansions of the tube bunch 105 in its hottest zone and of the second-group plates 113', which are also disposed in the hottest zone of the heat exchanger, can be taken up without stress due to the pivoted securing of the link ends.

During assembly of the heat exchanger, the two plate groups and/or the two parts 112, 112' of the displacement member can be rigidly interconnected, for instance, by tie rods, to protect the tubes 106 and to simplify assembly work.

As a variant, the heat exchanger can be disposed on a horizontal axis or at any desired inclination. The expansion zone 120 can be disposed in a higher region. The inlet connections and/or the outlet connections for the coolant and for the medium to be cooled can be disposed in some other way than illustrated. Those edges of the plates 113, 113' which border on the expansion zone can be devised differently from what is illustrated, in dependence upon the required expansion properties of the helically extending tubes in the expansion zone. The jacket 114 can be omitted or take the form, for instance, of a tubed wall.

If temperatures are high enough, the pressure vessel can be insulated internally or externally or on both sides at least in the hot zone.

At least one of the plate groups can be slidingly connected to the jacket 114. In this case, the jacket 114 can be formed near each plate 113 with at least one axial slot for guiding a shoe or the like secured to the associated plate, the axial length of such shoe or the like being less than the axial length of the slot in accordance with Swiss Pat. No. 613,274.

More than four support plates can be provided and the number of support plates in any group can be different from the number of support plates in the other groups.

The invention thus provides a heat exchanger which is able to compensate for axial expansion of relatively long tube groups.

Further, the invention provides a heat exchanger which is of relatively simple construction and through which a secondary medium can flow from one end to the opposite end.

What is claimed is:

1. A heat exchanger comprising a pressure vessel defining a flow path for a flowable medium;

a tube bunch disposed within said flow path in said pressure vessel, said bunch having a plurality of tubes extending helically in coaxial cylindrical surfaces throughout said bunch;

at least two axially consecutive groups of support plates supporting said tube bunch and disposed in axially spaced relation to define a plate-free expansion zone therebetween, each said group including at least three plates circumferentially spaced about said tube bunch, each said group supported in said pressure vessel at ends opposite each other;

a multi-armed spider secured to and within an upper end of said vessel with one of said groups of support plates being secured to said spider; and a tubular displacement member including two parts telescopically disposed within each other, one of said parts being secured to said one group of support plates and the other of said parts being secured to the other of said group of support plates.

2. A heat exchanger as set forth in claim 1 wherein said expansion zone is of decreasing axial extent in an outward radial direction.

3. A heat exchanger as set forth in claim 1 which further comprises an inlet connection laterally on said pressure vessel for supplying a secondary medium to said tube bunches and an outlet connection laterally on said pressure vessel for receiving the secondary medium from said tube bunches.

4. A heat exchanger comprising a pressure vessel defining a flow path for a flowable medium;

a tube bunch disposed within said flow path in said pressure vessel, said tube bunch having a plurality of tubes extending helically in coaxial cylindrical surfaces;

at least two axially consecutive groups of support plates supporting said tube bunch and disposed in axially spaced relation to define a plate-free expansion zone therebetween, each said group including at least three plates circumferentially spaced about said tube bunch, each said group being supported in said pressure vessel at ends opposite each other; and a tubular displacement member disposed centrally of said tube bunch within said pressure vessel, said member including two parts telescopically disposed within each other at said expansion zone, one of said parts being secured to one group of plates and the other of said parts being secured to the other group of plates.

5. A heat exchanger as set forth in claim 4 wherein said expansion zone is of decreasing axial extent in an outward radial direction.

6. A heat exchanger comprising a pressure vessel defining a flow path for a flowable medium;

a tube bunch disposed within said flow path in said pressure vessel, said tube bunch having a plurality of tubes disposed helically about a central axis of said pressure vessel; and a support system within said pressure vessel for supporting said tube bunch therein, said system including two groups of support plates disposed in axially spaced ralation to define a plate-free expansion zone therebetween with each group secured in said pressure vessel at ends opposite each other and a displacement member disposed on said axis of said pressure vessel, said member having a pair of coaxial parts slidably mounted in telescopic relation with each other, one of said parts being secured to one of said groups of support plates and the other of said parts being secured to the other of said groups of support plates.

7. A heat exchanger as set forth in claim 6 wherein said support system further includes a plurality of links, each said link being pivotally secured to a respective plate of said other group of plates and pivotally secured to said pressure vessel.

8. A heat exchanger as set forth in claim 7 wherein said pressure vessel axis is vertically disposed.

9. A heat exchanger as set forth in claim 6 wherein said expansion zone is of decreasing axial extent in an outward radial direction.

10. A heat exchanger comprising a pressure vessel defining a flow path for a flowable medium;

a tube bunch disposed within said flow path in said pressure vessel, said tube bunch having a plurality of tubes disposed helically about a central axis of said pressure vessel;

a cylindrical jacket mounted within said pressure vessel; and a support system within said pressure vessel for supporting said tube bunches therein, said system including two groups of support plates disposed in axially spaced relation to define a plate-free expansion zone therebetween with each group secured in said pressure vessel at ends opposite each other, and a multi-armed spider secured to and within one end of said jacket, and a displacement member having one part secured to and within said spider and a second part slidably mounted in telescopic relation with said one part, one of said groups of plates being secured to said arms of said spider and the other of said groups of plates being secured to said second part for movement therewith.

11. A heat exchanger as set forth in claim 10 which further comprises an inlet connection laterally on said pressure vessel for supplying a secondary medium to said tube bunches and an outlet connection laterally on said pressure vessel for receiving the secondary medium from said tube bunches.

12. A heat exchanger as set forth in claim 10 wherein said expansion zone is of decreasing axial extent in an outward radial direction.

* * * * *

UNITED STATES PATENT AND TRADEMARK OFFICE

CERTIFICATE OF CORRECTION

PATENT NO. : 4,687,052

DATED : August 18, 1987

INVENTOR(S) : Hans Fricker

It is certified that error appears in the above-identified patent and that said Letters Patent is hereby corrected as shown below:

Column 2, line 39 cancel "of"
Column 2, line 41 "extends" should be -extend-
Column 2, line 41 "sinously" should be -sinuously-
Column 2, line 47 "pressure" should be -pressure vessel-
Column 3, line 17 "plate" should be -plates-
Column 6, line 14 "ralation" should be -relation-

Signed and Sealed this

Ninth Day of February, 1988

*Attest:*

DONALD J. QUIGG

*Attesting Officer*

*Commissioner of Patents and Trademarks*